US005938865A

United States Patent [19]

Kondo et al.

[11] Patent Number: 5,938,865

[45] Date of Patent: Aug. 17, 1999

[54] PROCESS FOR PRODUCING HIGH-STRENGTH SEAMLESS STEEL PIPE HAVING EXCELLENT SULFIDE STRESS CRACKING RESISTANCE

[75] Inventors: Kunio Kondo; Takahiro Kushida, both of Osaka; Hajime Osako; Hideki Takabe, both of Wakayama, all of Japan

[73] Assignee: Sumitomo Metal Industries, LTC., Osaka, Japan

[21] Appl. No.: 08/952,222

[22] PCT Filed: May 15, 1996

[86] PCT No.: PCT/JP96/01274

§ 371 Date: Feb. 5, 1998

§ 102(e) Date: Feb. 5, 1998

[87] PCT Pub. No.: WO96/36742

PCT Pub. Date: Nov. 21, 1996

[30] Foreign Application Priority Data

| | | | |
|---|---|---|---|
| May 15, 1995 | [JP] | Japan | 7-116023 |
| Jun. 14, 1995 | [JP] | Japan | 7-147844 |
| Jun. 14, 1995 | [JP] | Japan | 7-147845 |
| Jul. 7, 1995 | [JP] | Japan | 7-171872 |

[51] Int. Cl.[6] ..... C21D 8/10

[52] U.S. Cl. ..... 148/593

[58] Field of Search ..... 148/593

[56] References Cited

FOREIGN PATENT DOCUMENTS

| | | |
|---|---|---|
| 54-117311 | 9/1979 | Japan . |
| 56-3626 | 1/1981 | Japan . |
| 58-91123 | 5/1983 | Japan . |
| 58-104120 | 6/1983 | Japan . |
| 58-117832 | 7/1983 | Japan . |
| 58-224116 | 12/1983 | Japan . |
| 60-043424 | 3/1985 | Japan . |
| 60-046317 | 3/1985 | Japan . |
| 60-046318 | 3/1985 | Japan . |
| 60-052520 | 3/1985 | Japan . |
| 60-067623 | 4/1985 | Japan . |
| 60-75523 | 4/1985 | Japan . |
| 60-086208 | 5/1985 | Japan . |
| 60-086209 | 5/1985 | Japan . |
| 61-009519 | 1/1986 | Japan . |
| 61-238917 | 10/1986 | Japan . |
| 62-030849 | 2/1987 | Japan . |

(List continued on next page.)

*Primary Examiner*—Deborah Yee
*Attorney, Agent, or Firm*—Armstrong, Westerman, Hattori, McLeland & Naughton

[57] ABSTRACT

A process for producing a seamless steel pipe wherein pipe manufacturing steps and the heat treatment steps are carried out in one production line. The properties of the pipe are comparative or superior to those of the pipe manufactured in the conventional reheating, quenching and tempering process. The process is characterized by using the billet of a low alloy steel containing C: 0.15–0.50%, Cr: 0.1–1.5%, Mo: 0.1–1.5%, Al: 0.005–0.50%, Ti: 0.005–0.50% and Nb: 0.003–0.50%, and comprising the following steps (1) to (5).

(1) hot rolling with 40% or more of cross sectional reduction ratio, (2) finishing the hot rolling in a temperature range of 800–1100° C., (3) putting the manufactured steel pipe promptly in a complementary heating apparatus after the finish rolling, and complementarily heating at the temperature and time satisfying the following formula (a).

(4) quenching the steel pipe immediately after taking out of the complementary heating apparatus, and (5) tempering the pipe at a temperature not higher than the $Ac_1$ transformation point as the last heat treatment.

$$23500 \leq (T+273) \times (21+\log t) \leq 26000 \quad \text{(a)}$$

where, T (°C.) is a temperature of not lower than 850° C., and t is time (hr). Further, an intermediate heat treatment consisting of quenching or combination of quenching and tempering may be applied between the steps (4) and (5).

7 Claims, 8 Drawing Sheets

FOREIGN PATENT DOCUMENTS

| | | |
|---|---|---|
| 62-139815 | 6/1987 | Japan . |
| 62-149813 | 7/1987 | Japan . |
| 62-253720 | 11/1987 | Japan . |
| 63-11621 | 1/1988 | Japan . |
| 63-093822 | 4/1988 | Japan . |
| 63-223125 | 9/1988 | Japan . |
| 63-238242 | 10/1988 | Japan . |
| 63-274717 | 11/1988 | Japan . |
| 01055335 | 3/1989 | Japan . |
| 4-358023 | 12/1992 | Japan . |
| 05255749 | 10/1993 | Japan . |
| 05255750 | 10/1993 | Japan . |
| 05271772 | 10/1993 | Japan . |
| 06172854 | 6/1994 | Japan . |
| 06172859 | 6/1994 | Japan . |
| 6-172858 | 6/1994 | Japan . |
| 06184635 | 7/1994 | Japan . |
| 06184711 | 7/1994 | Japan . |
| 06220536 | 8/1994 | Japan . |

Fig. 3

| | Steel | Chemical Composition (weight %, Fe : bal.) | | | | | | | | | | | | | | | *fnl |
|---|---|---|---|---|---|---|---|---|---|---|---|---|---|---|---|---|---|
| | | C | Si | Mn | P | S | Cr | Ni | Mo | sol.Al | Ti | Nb | B | N | O | Others | |
| Steels for the Process of This Invention | a | 0.23 | 0.21 | 0.45 | 0.019 | 0.0011 | 0.54 | 0.01 | 0.69 | 0.013 | 0.025 | 0.032 | 0.0009 | 0.0025 | 0.0018 | | 0.0164 |
| | b | 0.25 | 0.28 | 0.39 | 0.014 | 0.0015 | 0.51 | 0.01 | 1.12 | 0.015 | 0.019 | 0.035 | 0.0008 | 0.0019 | 0.0022 | Zr:0.015 Ca:0.0015 | 0.0204 |
| | c | 0.28 | 0.80 | 1.21 | 0.022 | 0.0042 | 1.05 | 0.02 | 0.43 | 0.018 | 0.008 | 0.103 | — | 0.0072 | 0.0022 | Zr:0.053 | 0.0113 |
| | d | 0.45 | 0.25 | 0.53 | 0.031 | 0.0038 | 0.23 | 0.01 | 0.89 | 0.019 | 0.019 | 0.027 | — | 0.0053 | 0.0025 | Ca:0.0018 | 0.0008 |
| | e | 0.22 | 0.34 | 0.48 | 0.013 | 0.0009 | 0.44 | 0.01 | 0.38 | 0.021 | 0.021 | 0.036 | 0.0007 | 0.0028 | 0.0015 | W:0.82 | 0.0114 |
| | f | 0.23 | 0.42 | 0.49 | 0.017 | 0.0012 | 0.65 | 0.01 | 0.52 | 0.019 | 0.020 | 0.039 | 0.0011 | 0.0033 | 0.0018 | V:0.18 | 0.0087 |
| | g | 0.24 | 0.04 | 0.16 | 0.015 | 0.0012 | 0.59 | 0.01 | 0.72 | 0.014 | 0.026 | 0.034 | 0.0009 | 0.0027 | 0.0015 | | 0.0167 |
| | h | 0.23 | 0.18 | 0.03 | 0.016 | 0.0013 | 0.53 | 0.01 | 0.69 | 0.011 | 0.021 | 0.035 | 0.0007 | 0.0023 | 0.0014 | | 0.0131 |
| | i | 0.24 | 0.03 | 0.04 | 0.016 | 0.0012 | 0.52 | 0.01 | 0.70 | 0.012 | 0.024 | 0.034 | 0.0008 | 0.0028 | 0.0021 | | 0.0144 |
| | j | 0.23 | 0.23 | 0.41 | 0.004 | 0.0010 | 0.54 | 0.01 | 0.71 | 0.017 | 0.022 | 0.037 | 0.0009 | 0.0018 | 0.0023 | | 0.0158 |
| | k | 0.22 | 0.22 | 0.42 | 0.012 | 0.0005 | 0.55 | 0.01 | 0.73 | 0.018 | 0.027 | 0.036 | 0.0008 | 0.0022 | 0.0019 | | 0.0195 |
| | l | 0.22 | 0.24 | 0.42 | 0.003 | 0.0004 | 0.55 | 0.01 | 0.71 | 0.019 | 0.022 | 0.035 | 0.0009 | 0.0023 | 0.0020 | | 0.0141 |
| | m | 0.23 | 0.05 | 0.06 | 0.001 | 0.0002 | 0.48 | 0.01 | 0.72 | 0.023 | 0.015 | 0.039 | 0.0008 | 0.0023 | 0.0014 | | 0.0071 |
| | n | 0.24 | 0.33 | 0.43 | 0.015 | 0.0010 | 0.54 | 0.01 | 0.15 | 0.020 | 0.022 | 0.037 | 0.0012 | 0.0032 | 0.0015 | W:1.45 | 0.0110 |
| | o | 0.23 | 0.29 | 0.42 | 0.015 | 0.0011 | 0.45 | 0.01 | 0.31 | 0.018 | 0.012 | 0.038 | 0.0009 | 0.0023 | 0.0013 | V:0.29 | 0.0041 |
| Comparative Steels | p | 0.25 | 0.36 | 0.55 | 0.023 | 0.0014 | ☆0.01 | 0.01 | 0.51 | 0.022 | 0.021 | 0.025 | 0.0008 | 0.0034 | 0.0015 | | 0.0093 |
| | q | 0.23 | 0.31 | 0.62 | 0.026 | 0.0019 | 0.72 | 0.01 | ☆0.01 | 0.025 | 0.022 | 0.021 | 0.0007 | 0.0029 | 0.0014 | | 0.0121 |
| | r | 0.23 | 0.28 | 0.52 | 0.026 | 0.0018 | 0.65 | 0.01 | 0.52 | 0.019 | 0.024 | ☆ — | 0.0008 | 0.0041 | 0.0020 | | 0.0121 |
| | s | 0.24 | 0.43 | 0.48 | 0.025 | 0.0020 | 0.68 | 0.01 | 0.43 | 0.024 | ☆ — | ☆ — | 0.0008 | 0.0035 | 0.0021 | | 0.0120 |

Note: $*fnl = Ti(\%) - (48/14) \times \{N(\%) - (14/91) \times Zr(\%)\}$
☆ Out of the scope of this invention

Fig. 4

| | Test No. | Steel | Threshold Stress of SSC Resistance (kgf/mm²) |
|---|---|---|---|
| Examples of This Invention | 1 | a | 101.1 |
| | 2 | b | 102.0 |
| | 3 | c | 103.4 |
| | 4 | d | 103.2 |
| | 5 | e | 104.1 |
| | 6 | f | 106.5 |
| | 7 | g | 102.5 |
| | 8 | h | 102.3 |
| | 9 | i | 105.8 |
| | 10 | j | 107.5 |
| | 11 | k | 106.4 |
| | 12 | l | 108.0 |
| | 13 | m | 110.5 |
| | 14 | n | 105.6 |
| | 15 | o | 106.7 |
| Comparative Examples | 16 | p | 92.3 |
| | 17 | q | 87.9 |
| | 18 | r | 91.9 |
| | 19 | s | 89.1 |

Fig. 5

| | Test No. | Steel | Billet Heating Temp. (℃) | Reduction of Rough Rolling (%) | Total Reduction of Rolling (%) | Finish Rolling Temp. (℃) | Complementary Heating | | ** f n 2 | In-line Quenching (℃) | Tempering Temp. (℃) | Quenching Temp. (℃) | Tempering Temp. (℃) |
|---|---|---|---|---|---|---|---|---|---|---|---|---|---|
| | | | | | | | Temp. (℃) | Time | | | | | |
| Examples of This Invention | 1 | a | 1150 | 50 | 80 | 900 | 870 | 30 min | 23659 | 850 | 700 | — | — |
| | 2 | a | 1250 | 50 | 50 | 850 | 950 | 1 min | 23508 | 870 | — | 920 | 650 |
| | 3 | a | 1200 | 50 | 60 | 900 | 950 | 5 min | 24363 | 910 | 600 | 920 | 650 |
| | 4 | b | 1250 | 30 | 50 | 1000 | 950 | 5 min | 24363 | 870 | 710 | — | — |
| | 5 | b | 1250 | 50 | 50 | 900 | 1050 | 2 min | 25829 | 1020 | — | 900 | 660 |
| | 6 | b | 1250 | 50 | 50 | 800 | 850 | 60 min | 23583 | 830 | 600 | 910 | 660 |
| | 7 | e | 1250 | 50 | 50 | 900 | 910 | 5 min | 23566 | 870 | 680 | — | — |
| | 8 | e | 1250 | 30 | 50 | 950 | 1000 | 1 min | 24469 | 970 | — | 920 | 640 |
| | 9 | e | 1150 | 30 | 40 | 850 | 910 | 5 min | 23566 | 880 | 600 | 930 | 640 |
| | 10 | n | 1200 | 50 | 50 | 900 | 900 | 30 min | 24280 | 870 | 690 | — | — |
| | 11 | n | 1250 | 50 | 70 | 900 | 950 | 5 min | 24363 | 910 | — | 890 | 640 |
| | 12 | n | 1250 | 30 | 40 | 850 | 910 | 5 min | 23566 | 870 | 600 | 920 | 630 |
| | 13 | f | 1150 | 30 | 70 | 950 | 950 | 5 min | 24363 | 930 | 700 | — | — |
| | 14 | f | 1200 | 30 | 50 | 850 | 960 | 1 min | 23701 | 890 | — | 910 | 660 |
| | 15 | f | 1250 | 40 | 50 | 1050 | 1100 | 30 sec | 25978 | 1060 | 600 | 920 | 660 |
| | 16 | o | 1150 | 40 | 70 | 900 | 900 | 30 min | 24280 | 870 | 710 | — | — |
| | 17 | o | 1250 | 50 | 50 | 1000 | 1050 | 2 min | 25829 | 1020 | — | 920 | 670 |
| | 18 | o | 1250 | 50 | 40 | 850 | 950 | 1 min | 23508 | 930 | 600 | 920 | 680 |
| | 19 | l | 1250 | 50 | 50 | 1000 | 950 | 5 min | 24363 | 930 | 670 | — | — |
| | 20 | l | 1220 | 45 | 45 | 1050 | 1100 | 20 sec | 25737 | 1060 | — | 910 | 640 |
| | 21 | l | 1250 | 40 | 70 | 800 | 910 | 5 min | 23566 | 840 | 600 | 920 | 630 |
| | 22 | m | 1200 | 50 | 70 | 1000 | 980 | 1 min | 24085 | 970 | 670 | — | — |
| | 23 | m | 1230 | 60 | 50 | 1000 | 1050 | 2 min | 25829 | 1000 | — | 920 | 630 |
| | 24 | m | 1250 | 50 | 60 | 1000 | 1000 | 5 min | 25359 | 970 | 600 | 920 | 640 |

Note ** : $f\,n\,2 = (T+273) \times (21 + \log t)$, where T: Temperature (℃), t: Time (hr)

Fig. 6

| | Test No. | Steel | Billet Heating Temp. (°C) | Reduction of Rough Rolling (%) | Total Reduction of Rolling (%) | Finish Rolling Temp. (°C) | Complementary Heating | | ** f n 2 | In-line Quenching (°C) | Tempering Temp. (°C) | Quenching Temp. (°C) | Tempering Temp. (°C) |
|---|---|---|---|---|---|---|---|---|---|---|---|---|---|
| | | | | | | | Temp. (°C) | Time | | | | | |
| Comparative Examples | 25 | a | 1250 | 50 | *5 | 900 | 1100 | 20 sec | 25737 | 1050 | — | 920 | 650 |
| | 26 | a | 1250 | 50 | 50 | *1110 | 950 | 5 min | 24363 | 920 | 690 | — | — |
| | 27 | a | 1250 | 30 | 70 | 950 | 1150 | 5 min | *28347 | 1100 | 690 | — | — |
| | 28 | a | 1200 | 50 | 50 | 1000 | * None | — | — | 980 | 680 | — | — |
| | 29 | a | 1250 | 50 | 60 | 900 | * 700 | 30 min | *20140 | 680 | 600 | — | — |
| | 30 | m | 1250 | 50 | *5 | 940 | 1100 | 20 sec | 25737 | 1050 | 660 | 930 | 630 |
| | 31 | m | 1250 | 50 | 50 | *1120 | 950 | 5 min | 24363 | 920 | 670 | — | — |
| | 32 | m | 1250 | 30 | 70 | 950 | 1150 | 5 min | *28347 | 1100 | 680 | — | — |
| | 33 | m | 1200 | 50 | 50 | 1000 | * None | — | — | 980 | 650 | — | — |
| | 34 | m | 1250 | 50 | 50 | *1120 | *690 | 30 min | *19933 | 920 | 580 | — | — |
| Conventional Examples | 35 | a | 1200 | 30 | 50 | 850 | — | — | | | | 920 | 640 |
| | 36 | b | 1200 | 50 | 50 | 1000 | — | — | | | | 920 | 650 |
| | 37 | e | 1250 | 50 | 70 | 900 | — | — | | | | 920 | 620 |
| | 38 | n | 1250 | 50 | 50 | 900 | — | — | | * as rolled | | 920 | 620 |
| | 39 | f | 1250 | 50 | 60 | 950 | — | — | | | | 910 | 630 |
| | 40 | o | 1200 | 50 | 50 | 1000 | — | — | | | | 920 | 620 |
| | 41 | l | 1250 | 50 | 70 | 900 | — | — | | | | 920 | 610 |
| | 42 | m | 1200 | 40 | 40 | 950 | — | — | | | | 920 | 620 |

注. * : Out of the scope of this invention
** : $f n 2 = (T+273) \times (21 + \log t)$, where T: Temperature (°C), t : Time (hr)

| | Test No. | Steel | Yield Strength (kgf/mm²) | Tensile Strength (kgf/mm²) | Constant Load Test (Method-A) | S c Value | Toughness vTrs (°C) | Abnormal Grain Growth |
|---|---|---|---|---|---|---|---|---|
| Examples of This Invention | 1 | a | 91.8 | 98.2 | No fracture | 10.5 | −52 | None |
| | 2 | a | 91.2 | 97.1 | No fracture | 12.0 | −66 | None |
| | 3 | a | 91.9 | 98.1 | No fracture | 12.0 | −74 | None |
| | 4 | b | 90.3 | 98.1 | No fracture | 12.5 | −69 | None |
| | 5 | b | 91.3 | 97.0 | No fracture | 13.0 | −83 | None |
| | 6 | b | 91.0 | 97.7 | No fracture | 13.5 | −83 | None |
| | 7 | e | 102.3 | 105.5 | No fracture | 11.0 | −48 | None |
| | 8 | e | 100.3 | 106.7 | No fracture | 12.5 | −65 | None |
| | 9 | e | 100.0 | 104.9 | No fracture | 12.0 | −70 | None |
| | 10 | n | 102.0 | 107.1 | No fracture | 13.0 | −71 | None |
| | 11 | n | 100.2 | 105.6 | No fracture | 13.5 | −73 | None |
| | 12 | n | 100.4 | 106.4 | No fracture | 13.5 | −74 | None |
| | 13 | f | 99.4 | 106.6 | No fracture | 11.0 | −51 | None |
| | 14 | f | 100.4 | 106.7 | No fracture | 12.0 | −80 | None |
| | 15 | f | 100.6 | 107.5 | No fracture | 12.0 | −81 | None |
| | 16 | o | 100.7 | 105.7 | No fracture | 13.0 | −73 | None |
| | 17 | o | 100.8 | 106.5 | No fracture | 13.0 | −71 | None |
| | 18 | o | 100.3 | 104.7 | No fracture | 13.5 | −70 | None |
| | 19 | l | 102.0 | 105.1 | No fracture | 11.5 | −55 | None |
| | 20 | l | 101.4 | 104.9 | No fracture | 12.5 | −78 | None |
| | 21 | l | 99.4 | 107.2 | No fracture | 13.0 | −79 | None |
| | 22 | m | 100.8 | 105.1 | No fracture | 12.5 | −63 | None |
| | 23 | m | 99.6 | 106.3 | No fracture | 13.0 | −74 | None |
| | 24 | m | 101.0 | 106.2 | No fracture | 14.0 | −84 | None |

Fig. 7

| | Test No. | Steel | Yield Strength (kgf/mm²) | Tensile Strength (kgf/mm²) | Constant Load Test (Method-A) | S c Value | Toughness vTrs (°C) | Abnormal Grain Growth |
|---|---|---|---|---|---|---|---|---|
| Comparative Examples | 25 | a | 90.9 | 98.0 | Fracture | 9.0 | −29 | Present |
| | 26 | a | 91.9 | 98.3 | Fracture | 9.5 | −15 | Present |
| | 27 | a | 90.8 | 98.2 | Fracture | 11.5 | −38 | None |
| | 28 | a | 91.4 | 98.1 | Fracture | 9.5 | −44 | Present |
| | 29 | a | 49.9 | 75.0 | Fracture | 9.0 | 28 | None |
| | 30 | m | 100.2 | 105.9 | Fracture | 8.5 | −24 | Present |
| | 31 | m | 102.1 | 107.0 | Fracture | 9.0 | −19 | Present |
| | 32 | m | 102.0 | 106.9 | Fracture | 11.0 | −41 | None |
| | 33 | m | 100.6 | 106.6 | Fracture | 10.5 | −48 | Present |
| | 34 | m | 53.1 | 77.0 | Fracture | 9.0 | 21 | None |
| Conventional Examples | 35 | a | 90.9 | 96.7 | Fracture | 11.5 | −68 | None |
| | 36 | b | 90.6 | 106.6 | Fracture | 12.0 | −48 | None |
| | 37 | e | 99.8 | 105.1 | Fracture | 11.5 | −42 | None |
| | 38 | n | 100.8 | 106.1 | Fracture | 12.5 | −52 | None |
| | 39 | f | 99.6 | 107.5 | Fracture | 12.0 | −55 | None |
| | 40 | o | 100.6 | 107.3 | Fracture | 12.0 | −46 | None |
| | 41 | l | 100.6 | 106.6 | Fracture | 10.5 | −48 | None |
| | 42 | m | 101.7 | 105.1 | Fracture | 12.5 | −49 | None |

Fig. 8

PROCESS FOR PRODUCING HIGH-STRENGTH SEAMLESS STEEL PIPE HAVING EXCELLENT SULFIDE STRESS CRACKING RESISTANCE

TECHNICAL FIELD

The present invention relates to a process for producing a seamless steel pipe having high strength and excellent corrosion resistance, especially sulfide stress cracking resistance. More particularly, the invention relates to a process for producing a seamless steel pipe having high strength, good toughness and excellent corrosion resistance, especially sulfide stress cracking resistance, which is characterized by a combination of specified chemical composition of raw materials (steel billet) and specified thermo-mechanical treatment of the material. The process is also characterized by being performed in a continuous line comprising steps of pipe manufacturing and heat treatment thereof.

BACKGROUND ART

In a steel production factory which requires huge facilities, simplification of the process using so-called "on-line processing" has been investigated in order to save energy and to shorten the process. The "on-line processing" means to perform work such as rolling and heat treatment in one continuous manufacturing line. In the on-line processing, a method wherein a hot worked product is immediately quenched for utilizing its heat in the working is called "direct quenching". On the other hand, a method wherein the hot worked product is once cooled, and then subjected to heat treatment in a separate line is called "off-line processing", and quenching which is carried out in the off-line processing is called "reheating and quenching".

Recently, in the field of steel plate making by hot rolling, the off-line processing is diminished and most of the plates are produced in the on-line processing. In manufacturing of seamless steel pipes, however, the heat treatments such as quenching and tempering of the products is still mostly conducted in the off-line processing, because it is considered that quality and reliability of the product are more important. Needless to say, it is necessary for the off-line processing to include hardening facilities (a heating furnace and quenching equipment) and a tempering furnace in a separate line from the pipe manufacturing line.

In the conventional pipe manufacturing process, seamless steel pipes are produced in a consecutive hot working process comprising steps of piercing a steel billet by a pierce, extending and rolling by a plug mill or a mandrel mill, and shape-finishing by a sizer or a reducer. Sometimes, a press machine is used for piercing. Usually, the pipe manufactured in a working line forming is reheated, quenched and then tempered in a line separate from the pipe manufacturing line. In this way, the seamless steel pipes provided with sufficient properties such as strength, toughness and the sulfide stress cracking resistance are supplied to customers. The sulfide stress cracking is a crack which appears in high strength steels exposed to an environment containing sulfide, particularly hydrogen sulfide ($H_2S$). The "sulfide stress cracking" is referred to as "SSC" hereafter.

If the above mentioned usual quenching step is replaced by the direct quenching, simplification of the manufacturing facilities and reduction of the production are achieved. As mentioned above, "direct quenching" means the treatment, wherein the product, after hot working, is immediately quenched. In detail, it means a method to obtain a hardened metal structure, consisting of martensite or bainite by direct quenching from an austenite state at a temperature higher than $Ar_3$ transformation point, in the hot working line.

For example, in Publication of Japanese Patent Application (referred to as PJPA hereafter) Nos. 58-224116, 60-75523 and 6-172859 disclose steel pipe manufacturing processes, including the direct quenching step such as enforced cooling, immediately after hot working. However, the pipes produced in the direct quenching process have coarse grain size in its microstructure and inferior toughness and corrosion resistance (SSC-resistance) in comparison with the pipes produced in the conventional off-line reheating and quenching process.

As mentioned above, the direct quenching tends to make the grain size of the product coarse in comparison with the conventional reheating and quenching. It had been thought that the direct quenching method was not suitable for manufacturing of a seamless steel pipe having high strength and high corrosion resistance because the pipe with coarse grain size is inferior in toughness and SSC-resistance, which are regarded as the most important properties of the seamless steel pipe.

As a method to refine crystal grains, a method has been proposed wherein the grain refining is performed by a combination of cooling and reheating for two phase transformations, i.e., transformation from austenite to ferrite and reverse transformation from ferrite to austenite. For example, a method wherein cooling and reheating steps are added intermediately to rough rolling and finish rolling is disclosed in PJPA No. 56-3626. Other methods wherein cooling and reheating steps are put together after finish rolling are disclosed in PJPA Nos. 58-91123, 58-104120, 63-11621 and 04-358023 respectively. Further, PJPA No. 58-117832 discloses a method in which two cooling and reheating steps are put into the process, one is during the rolling process, another is after rolling.

According to each method mentioned above, it is possible to refine the grains of the steel products which are directly quenched. However, each method includes the following problems.

① The refinement of the grains is still insufficient for a requirement for higher level corrosion resistance.

② Energy consumption to reheat the products, which have been once cooled to a temperature range for initiation and completion of transformation, to a temperature range wherein the reverse transformation is completed, is very large.

③ Since the above-mentioned methods require rather complicated and expensive facilities, the cost reduction of construction and operation is not so large in comparison with the off-line heat treatment.

In order to refine the grains further and improve hardenability of the steel, some methods wherein a steel product is direct quenched and tempered, after grain refining by hot working at non-recrystallization area and recrystallizing, are shown in PJPA No. 62-139815, No. 63-223125 and 64-55335.

In the method of the above mentioned No. 62-139815, strength and toughness of the product are improved by keeping the steel in a temperature range near to the finish rolling temperature, for recrystallization of austenite grains and retaining solute B (boron). This mechanism is based on a relationship between hardenability of the steel and the behavior of B during the process, from finish of hot rolling to quenching. The method of the said No. 63-223125 improves strength and toughness of the product by uniform fine grain structure of No. 8 or more of JIS grain size number. In this method, in order to get the said grain structure, the product is fully hot rolled in non-recrystallized temperature region, rapidly heated to a temperature for soaking for a short time, without cooling under Ar, transformation point, directly quenched, and tempered.

The above mentioned grain refining by direct quenching are concerned with a production technology for plate of low carbon steel in which recrystallization and grain growth occur relatively easily. If these methods are applied to a process of manufacturing a high strength corrosion resistant steel pipe for oil well use, it is difficult to obtain the same effect as the plate, since the seamless steel pipes for oil well use are made of medium carbon steels. Although rolling at a large working ratio is rather easy for the steel plate, especially of low carbon steel in the non-recrystallized condition in a comparatively low temperature area, the same rolling is extremely difficult for the steel pipe, especially of medium carbon steel, which is worked in a complicated rolling process. In other words, it is not easy to apply process steps for manufacturing steel plates to the process for producing steel pipes. In more detail, rolling at a large working ratio in the non-recrystallization temperature range below 1000° C. in the general pipe rolling method, such as the plug mill method or the mandrel mill method, causes problems of over capacity of the mill or difficulty of drawing off the mandrel bar from the pipe after rolling. Accordingly, some countermeasures against these problems are necessary.

Inventions for recrystallization during or after rolling step in the direct quenching process for seamless steel pipe making are disclosed in PJPA Nos. 61-238917, 05-255749, 05-255750 and 05-271772.

The invention of the above mentioned No. 61-238917 is characterized by controlling the recrystallization ratio before quenching to more than 90% and using a steel of a specified chemical composition with defining heating condition after hot rolling precisely. However, No. 61-238917 states nothing about the rolling condition of the seamless steel pipe for reasons that an improvement of toughness, by changing rolling condition, is not practical. If the heat treatment disclosed in No. 61-238917 is simply applied to the general pipe rolling process, such as the plug mill or mandrel mill process, desirable uniform fine grain structure is not always obtained. Furthermore, the heat treatment probably will promote grain growth and generate coarse grains.

PJPA Nos. 5-255749 and 5-255750 disclose methods of direct quenching in which a hollow shell of specified chemical composition is forcibly cooled to 1100–900° C. on the way of rolling and then rolled with a reduction of thickness in area of 15% or more into a pipe shell with an aimed outer diameter and thickness. Thereafter, the pipe is finish-rolled after re-heating at 900–1000° C., and then directly quenched. Austenite grain size of the pipe finally produced in this method is 8.9 of ASTM grain size number at most because the grain has grown by the re-heating before finish-rolling, even if very fine grain structure is obtained during the hot rolling step. In addition, in the method described above, abnormal grain growth occurs frequently because of relatively low reduction of finish-rolling so that the pipe does not always have uniform fine grain structure. As mentioned above, the process comprising the re-heating step on the way of hot-rolling is not always favorable to make grains fine and uniform. The re-heating temperature can be in a range wherein the grain growth does not occur. In this case, however, the structure of the pipe becomes elongated grain or mixed grain structure because rolling after the re-heating was carried out in the non recrystallization temperature range. In particular, the elongated grain structure deteriorates hardenability of steel and increases anisotropy of the mechanical properties. Accordingly, it is difficult to use the seamless steel pipe produced in this method, as the steel pipe must have particularly good corrosion resistance.

PJPA No. 5-271772 discloses a method of manufacturing a steel pipe which has more than 90% martensite structure, wherein the pipe made of a billet of specified chemical composition by primary rolling is reheated to 900~1000° C., and then is finish-rolled followed by direct quenching. However, No. 5-271772 does not state anything about the working conditions of steel pipe. As for this method, a uniform fine grain structure may not be always obtained, since the method is characterized by the re-heating of the pipe in this course of hot rolling is the same as the methods of preceding Nos. 5-255749 and 5-255750. Austenite grain size of the pipe obtained in this method, finally, is at most 7.3 of ASTM grain size number.

Methods for direct quenching of a steel pipe, the grains of which are refined, before quenching, by a combination of chemical composition of material and a specified arrangement of rolling mills, are disclosed in PJPA Nos. 5-271772, 6-172854, and 6-172858. In these methods, a hollow shell is formed into a finish product by two or more diagonally inclined roll mills (skew-roll mills) arranged in tandem. The deformation mode of rolling in the skew roll mill, contains a lot of shear strain component. In these methods, the hollow shell is rolled at a lower temperature than usual in each mill or in the first mill, and the temperature of the pipe is increased by working heat. The pipe is successively rolled in the skew-roll mill and finish rolled to the final products. Occasionally the pipe is re-heated before the finish rolling, i.e., after the last rolling in the skew-rolling mill. Under the rolling conditions of temperature and reduction ratio specified in these patent bulletins, the pipe receives severe deformation, even if the rolling is carried out in the skew-rolling mill, and the produced pipe has defects (surface defects) frequently. Furthermore, austenite grain size of the pipe, produced in this method, is 10.7 of ASTM grain size number at most because the reduction ratio in the finish rolling is too small.

Recently improvement of SSC-resistance of seamless steel pipes, particularly pipes for oil wells, has become an important subject, as the mining of high corrosive crude oil containing much sulfide has become active. As for the technology to improve SSC-resistance, methods for refining the grain structure of the pipe in a process comprising one or more reheating-quenching cycles were disclosed in PJPA Nos. 6-220536, 60-43424, 60-52520, 60-46318, 60-86208, 60-46317 and 60-86209, for example.

The above-mentioned No. 6-220536 discloses a method wherein a steel pipe, having a specified chemical composition, is reheated and quenched again after direct quenching. However, there is no description in No. 6-220536 about the working conditions of the steel pipe, especially the finish rolling condition just before direct quenching. If a steel pipe is subjected to direct-quenching after finish-rolling in the usual rolling method for seamless steel pipe by the plug mill or mandrel mill, the micro structure of the produced pipe does not always become ultra fine uniform grain structure because abnormal grain growth occurs frequently at reheating and quenching treatment, after direct-quenching. The pipe thus produced may be inferior in corrosion resistance.

The above-mentioned PJPA Nos. 60-43424 and 60-52520 disclose methods in which steels are reheated then quenched after direct quenching. In this method, the steels having specified chemical compositions are hot-rolled with not less than 20% reduction of thickness, at a temperature of 1000° C. or less, just before direct quenching. Although these methods are characterized by finish rolling at lower temperature range, such as 1100° C. or less, values of the reduction of thickness on rolling are about 40% at most, as indicated in examples. However, the steel only rolled with about 40% of reduction, never have satisfactorily refined austenite grains, after direct quenching, which become the initial grains in the reheating and quenching steps. Consequently, the reheating and quenching cycles should be repeated many times to obtain ultra fine grains of the steel.

PJPA Nos. 60-46318 and 60-86208 disclose a method of reheating and quenching of the pipes, wherein a steel having a specified chemical composition, is subjected to the primary-hot-rolling in austenite phase area and subjected to the secondary-hot-rolling, after being kept warm or being reheated, in order to suppress the initiation of transformation into ferrite phase and then the rolled steel is directly quenched. In this method, because the transformation is suppressed between the primary and secondary rolling steps, the austenite grains, after direct quenching, which become the initial grains in the reheating and quenching steps, can not be refined sufficiently. Therefore, the reheating and quenching cycles should be repeated many times, in order to obtain desirable fine grain structure. Since rolling conditions, especially the secondary rolling conditions before direct quenching, are not described at all in both of 60-46318 or 60-86208, it must be assumed that the secondary rolling (finish-rolling) is carried out under the usual conditions for general seamless steel pipe producing and then the pipe is direct quenched. In the steel pipe thus produced abnormal grain growth occurs frequently, contrary to expectation by the repeating of reheating-quenching cycle, therefore the steel pipe becomes inferior in corrosion resistance because the structure of the steel is not always ultra fine uniform grain.

PJPA Nos. 60-46317 and 60-86209 disclose methods of reheating and quenching of pipes, wherein a steel having specified chemical composition is primarily hot-rolled in the austenite phase area, and transformed into ferrite phase, thereafter reheated to austenite phase area once again, then secondarily hot-rolled and directly quenched. Austenite grains of the steel, after direct quenching, which will become initial grains in the reheating and quenching procedure become fine in this method because the steel transforms between the primary-hot-rolling and the secondary-hot-rolling. However, it is not preferable, in aspect of energy consumption increment, to cool the pipe to the temperature area of ferrite phase and then reheat to the area of austenite phase. Further, the method requires large equipment resulting in a remarkable rise of production costs. In addition, there is no description about rolling conditions, particularly the secondary hot-rolling condition, before direct quenching in both of 60-46317 and 60-86209. As mentioned above, when the secondary rolling (finish-rolling) is carried out under usual conditions for general seamless steel pipe making and the pipe is directly quenched, the abnormal grain growth occurs on the contrary in the reheating and quenching procedure, therefore the pipe becomes frequently inferior in corrosion resistance because the structure of the steel is not always ultra fine uniform grain.

A lot of studies have been done about relation between metallography of steel and SSC, in order to improve SSC-resistance of the steel. Some of the methods to improve SSC-resistance of the steel metallographically are as follows: ① specifying chemical composition of the steel, ② specifying metal structure, ③ improving heat-treatment technique, and ④ combination of the above-mentioned methods.

At first, as for the methods of specifying chemical composition, PJPA No. 62-253720 shows a method of specifying Si, Mn, P and Mo content and yield strength of the steel, No. 63-274717 shows a method of selecting high carbon steel, and No. 62-149813 and No. 63-238242 show methods of adding Zr to steel, respectively. Since W (tungsten) is an element of the same group in the periodic table and is similar to Mo in chemical properties, W has been added together with Mo as an alloying element. For example, PJPA No. 60-52520 discloses a method in which steel containing 0.05–0.80% of Mo+(½) W is directly quenched and tempered, in order to improve SSC-resistance by suppression of impurity segregation. However, all the methods described in these PJPAs are based on usual direct quenching, therefore, it is difficult to depress the SSC of the high strength steel which has been subjected to the conventional direct quenching method, even if the chemical composition of the steel is specified, as mentioned above.

As for the improvement of metal structure, it is known widely that the structure, which mainly consists of tempered martensite, is superior in SSC-resistance of the steel and it's fine grain structure is desirable. In addition, a method of forming bainite structure and a method of forming elongated grain structure are disclosed in PJPA Nos. 63-93822 and 62-30849, respectively. Further, as a heat treatment technique to obtain fine grain structure, other methods using rapid heating by an induction heating equipments etc. are disclosed in PJPA No. 54-117311 or 61-9519. These methods, however use the conventional reheating and quenching technology. Therefore, although their effect of improvement of SSC-resistance of the steel are recognized, the methods can not satisfy the industrial requirement for producing high quality seamless steel pipes at higher productivity, by the direct quenching technology using economical facilities.

DISCLOSURE OF THE INVENTION

Regarding the conventional manufacture method of seamless steel pipes, a raw pipe, i.e., a hollow shell, which has been made of a steel billet by means of a skew-roll mill (piercing mill), is elongated and expanded with a plug mill or mandrel and finish-rolled with a sizer or reducer to the pipe. The process up to this step is called "pipe manufacturing process". The manufactured seamless steel pipe is shipped, after heat treatment (usually, quench and temper for high strength steel pipes), which provides the pipe with required mechanical properties and corrosion resistance.

There is a technological trend to carry out the above mentioned heat treatment procedure in the line of the pipe manufacturing process in order to achieve an economical process and facilities. The direct quenching process is a typical one. However, as mentioned above, there are many problems in the direct quenching process for seamless steel pipes which have been proposed hitherto; and by using these processes it is difficult to produce steel pipes having properties equal or superior to those of the pipes treated in the "off-line reheating and quenching procedure".

The primary object of the present invention is to provide a process for producing a seamless steel pipe having properties superior to those of the pipe produced in the conventional "off-line reheating and quenching procedure"; and the process being rational and economical, the same as the conventional direct quenching process, wherein the manufactured pipe is heat treated in a serial line connected directly with the pipe manufacturing line.

In more detail, the object of the present invention is to provide a process for mass-producing C110 grade or over seamless steel pipes with superior SSC-resistance economically.

The C110 grade means a grade of high strength seamless steel pipe with 110–125 ksi (77–88 kgf/mm$^2$) in yield strength. This is a standard grade used among manufacturers of oil well tubular goods as a grade over C90 grade of API (American Petroleum Institute) in respect of the high strength corrosion resistance seamless steel pipe. Further, some grades higher than C110 such as C125 grade (yield strength: 125–140 ksi, i.e., 88–98 kgf/mm$^2$) and C140 grade (yield strength: 140–155 ksi, i.e., 98–109 kgf/mm$^2$) have being inquired. This invention is concerned with the producing all of these grades of high strength seamless steel pipes.

The target of SSC-resistance is that the crack initiation threshold stress (σth) of the steel pipe in NACE TM 0177 bath (mentioned later in detail) is 80% or more of the specified minimum yield strength of each grade.

The process of this invention to achieve the above mentioned objects is as follows: (in the following, "%" of alloying element content means "weight %").

A process for producing a seamless steel pipe having high strength and excellent SSC-resistance comprising steps of hot piercing and hot rolling, which is characterized by using a billet of low alloy steel which contains 0.15–0.50% of C, 0.1–1.5% of Cr, 0.1–1.5% of Mo, 0.005–0.50% of Al, 0.005–0.50% of Ti and 0.003–0.50% of Nb, and also characterized by comprising the following steps (1) to (5).

(1) hot rolling at 40% or more of cross sectional reduction ratio, (2) finishing the hot rolling in a temperature range of 800–1100° C., (3) putting the manufactured steel pipe promptly in a complementary heating apparatus after the finish rolling and complementarily heating at a temperature and time satisfying the following formula (a).

(4) quenching the steel pipe immediately after taking out of the complementary heating apparatus, and (5) tempering the pipe at a temperature not higher than $Ac_1$ transformation point as the last heat treatment.

$$23500 \leqq (T+273)\times(21+\log t) \leqq 26000 \quad \text{(a)}$$

where T (°C.) is a temperature of not lower than 850° C., and t is time (hr).

The process of this invention is characterized by the selection of optimum ranges of chemical composition of the steel billet, rolling condition and heat treating condition and combination of these ranges. In this process the pipe manufactured by hot rolling is put into the complementary heating apparatus immediately after finish rolling without virtual cooling. The complementary heating apparatus is equipped in the pipe manufacturing line and the steel pipe, taken out of the apparatus, is quenched to harden immediately. Accordingly, this method is essentially different from conventional "off-line re-heating and quenching method". On the other hand, since there is the complementary heating step between the pipe manufacturing process and the heat treatment (hardening) process, this method is also different from the conventional "direct quenching method". In order to clarify the difference in the process of these methods, the heat treatment of the process of this invention will be referred to as "in-line heat treatment" hereinafter, and the quenching treatment in this in-line heat treatment will be called "in-line quenching".

At least one intermediate heat treatment consisting of quenching or quenching and tempering can be inserted between the step (4) and (5). Reheating temperature for the quenching in the intermediate heat treatment should be in a range from $Ac_3$ point and '$Ac_3$ point+100° C'.

An example of preferable chemical composition of the steel billet for the process of this invention is as follows:

| | |
|---|---|
| C; 0.15 to 0.50% | Si; up to 1.5% |
| Mn; up to 1.5% | Cr; 0.1 to 1.5% |
| Mo; 0.1 to 1.5% | Al; 0.005 to 0.50% |
| Ti; 0.005 to 0.50% | Nb; 0.003 to 0.50% |
| N; up to 0.50% | O (oxygen); up to 0.01% |
| P; up to 0.05% | S; up to 0.01% |
| Ni; up to 0.1% | V; up to 0.5% |
| Zr; up to 0.5% | B; up to 0.01% |
| Ca; up to 0.01% | W; up to 2.0% |
| Fe and incidental impurities; the balance, | |

and contents of Ti, Zr and N are defined by the following formula (b).

$$Ti(\%)-(48/14)\times\{N(\%)-(14/91)\times Zr(\%)\} \quad \text{(b)}$$

Particularly, it is desirable that the amount of V is from 0.05 to 0.5%. Furthermore, it is desirable for more improved SSC-resistance that Si content and/or Mn content of the billet is not more than 0.1%.

P and S are impurities and contents of these impurities should be best as low as possible. It is more desirable that the amount of P and S is suppressed to not more than 0.005% and 0.0007%, respectively.

BRIEF DESCRIPTION OF THE DRAWINGS

FIG. 3 is a table showing chemical compositions of the steels being used in Example.

FIG. 4 is a table showing the crack initiation threshold stresses for SSC-resistance of the pipes produced in the process of this invention.

FIG. 5 and FIG. 6 are tables showing conditions for working and heat treating in the test of Example.

FIG. 7 and FIG. 8 are tables showing results of the tests according to the conditions in FIG. 5 and FIG. 6.

BEST MODE FOR CARRYING OUT THE INVENTION

Figure 1:
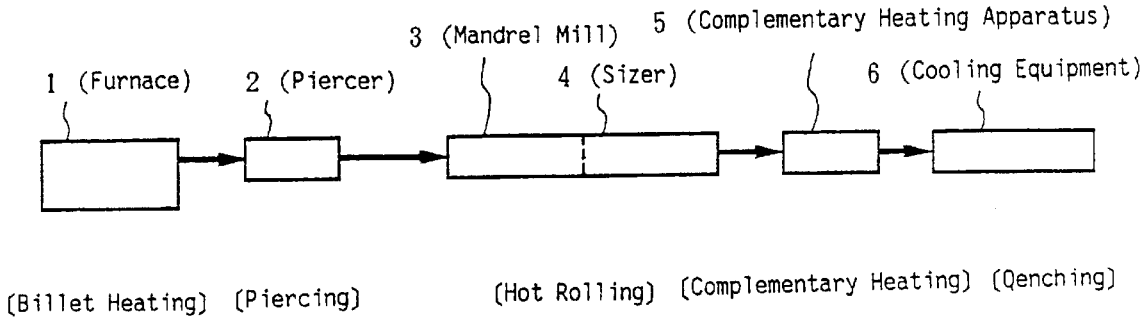
FIG. 1 is a flow diagram showing steps from billet heating to the "in-line quenching" in the seamless steel pipe producing process of this invention.

I. Chemical Composition of Material (Billet):

The billet is made of a low alloy steel which contains as essential alloying elements, C; 0.15 to 0.50%, Cr; 0.1 to 1.5%, Mo; 0.1 to 1.5%, Al; 0.005 to 0.50%, Ti; 0.005 to 0.50% and Nb; 0.003 to 0.50%. At first, the function and technical reasons for defining the content of each essential alloying element will be described.

C:

C is necessary to increase strength and to improve hardenability of the steel. If the amount of the C is less than 0.15%, the hardenability of the steel becomes insufficient and the high strength of the steel cannot be obtained. On the other hand, if the C content exceeds 0.50%, quenching cracking and delayed fracture tend to occur, and manufacture of seamless steel pipe becomes difficult. Therefore the C content is defined to a range from 0.15 to 0.50%. Preferable range of C content is 0.20 to 0.50%, and the most preferable range is 0.20 to 0.35%.

Cr:

Cr increases strength of the steel as the result of improvement of hardenability and also improves the SSC-resistance. Less than 0.1% Cr cannot produce these effects on steel. On the other hand, more than 1.5% Cr results in decrease of toughness and SSC-resistance of the steel. Accordingly, Cr content is defined to a range from 0.1 to 1.5%. Preferable range is from 0.3 to 1.2%.

Mo:

Mo increases strength of the steel owing to improvement of hardenability, too. This element increases resistance against temper softening of steel and also improves SSC-resistance. These effects are not obtained sufficiently with less than 0.1% Mo content. On the other hand, if the Mo content exceeds 1.5%, the effects of the Mo addition saturates and SSC-resistance is deteriorated because the excess of Mo precipitates needle-like fine carbide particles which have a large stress concentration coefficient and become crack initiating points of SSC. Accordingly, a reasonable Mo content range is from 0.1 to 1.5%. Preferable range of the Mo content is from 0.20 to 1.0%, and more preferably, 0.3 to 0.8%

Al:

Al is an element that is required for as a deoxidizing agent of steel. If Al content is less than 0.005%, the deoxidization effect can not be obtained; if Al content exceeds 0.5%, inclusions of the steel increase, toughness decreases and defects on threaded portions of the steel pipe tend to occur frequently. Therefore, an appropriate Al content range is 0.005 to 0.5%.

Ti:

Ti is contained in amounts enough to fix N, one of the impurities as TiN. As the result of fixing N, in case of B containing steel, for example, B exists a as solute in the steel without forming BN and contributes to improving the hardenability of the steel effectively. Solute Ti in the steel, i.e., Ti in amounts in excess of that required to form TiN tends to extend the non-recrystallization area of the steel up to higher temperature zone and assists to accumulate a part of strain of deformation at high temperatures. Steel having fine recrystallized grains is able to be obtained when comparatively low complementary heating temperature is selected and the steel is kept for a period of time, satisfying the formula (a) mentioned previously. Since the solute Ti precipitates finely during tempering after in-line quenching and improves the resistance to temper softening, Ti as well as Mo (Mo and W in case of W addition) makes it possible to temper the steel at a higher temperature. If the Ti content is less than 0.005%, the effect mentioned above is small. On the other hand, if the Ti content exceeds 0.50%, toughness of the steel is deteriorated.

Nb:

Nb-carbonitride, which dissolves in the steel during heating at high temperature before piercing, scarcely precipitates in the steps of rolling, complementary heating, and the in-line quenching because the precipiting rate of Nb-carbonitride is very small. However, small amounts of Nb-carbonitride precipitate as fine particles at the complementary heating step. Since the number of the particles is not so small, the particles inhibit coarsening of grains of the steel and prevent the abnormal grain growth at the in-line quenching step. Most of the solute Nb precipitates as fine particles of the carbonitride which improves resistance to temper softening of the steel and this effect results in improvement of SSC-resistance.

Since the solute Nb has an effect to extend the temperature range wherein the strain of deformation is accumulated, Nb is an indispensable alloying element in order to attain the fine recrystallized grain structure. The effect is larger than that of Ti.

When Nb content is less than 0.003%, various effects as mentioned above can not be obtained, and when the content is more than 0.50%, toughness of the steel deteriorates. Accordingly, an adequate Nb content range is 0.003 to 0.50%, and, preferably, range is 0.005 to 0.50%.

Combined addition of Ti and Nb:

One of characteristics of the billet for the process of this invention is that it is a medium carbon steel containing Nb and Ti together.

If the complementary heating procedure, under the condition defined in formula (a), is applied to the pipe which has been made of the billet containing Ti and Nb and has been rolled with a high reduction ratio, the pipe, prior to direct quenching, comprises a recrystallized grain structure containing many fine particles of Nb-Ti-carbonitride and an appropriate amount of dissolved Nb and Ti.

When Nb-Ti-carbonitride becomes coarse particles by coagulation, or most of the dissolved Nb and Ti is precipitated as Nb-Ti-carbonitride, even if the steel is quenched after the complementary heating procedure, the structure of uniform ultra fine grain and the effect of improving the resistance to temper softening can not be obtained. On the other hand, the steel pipe, which comprises a recrystallized grain structure containing appropriate amounts of dissolved Nb and Ti, surely has the uniform ultra fine grain structure because abnormal grain growth is suppressed by precipitated fine particles having an effect inhibiting grain boundary movement.

The solute Nb and Ti precipitates into fine particles of carbonitride during tempering, and remarkably increases the resistance to temper softening. Since the increase of resistance to temper softening makes it possible for quenched steel to be tempered at a higher temperature, more internal strain is relieved from this tempered steel than the conventional steels of the same strength level, and additionally, carbide in this steel spherodizes much more. Therefore, corrosion resistance, particularly SSC-resistance, is improved more. The above mentioned effects of uniforming and refining grain structure can be obtained only in case the steel contains both Nb and Ti in very small amounts.

Even if Nb or Ti is contained in the steel, in the case without the complementary heating before quenching, the steel transforms from a non-recrystallized structured by quenching. The steel, which has a structure transformed from non-recrystallized austenite state, does not exhibit excellent SSC-resistance. Fine austenite grain structure can be obtained only by the complementary heating procedure at low temperature range, wherein the steel, having accumulated some strain of deformation, is recrystallized. The steel quenched thereafter has a transformed fine structure exhibiting an excellent SSC-resistance.

The following is description about other alloying elements which may be contained optionally and impurities in the billet to be used in the process of this invention.

Si:

Si is an element contained inevitably in steel and contributes to deoxidation of the steel. Since the element increases resistance to temper softening of the steel and thereby improves SSC-resistance, it may be added positively in an amount of not less than 0.1%. However, since more than 1.5% of Si deteriorates toughness and SSC-resistance of the steel unexpectedly, the Si content should be not more than 1.5%.

If Si content is depressed less than 0.1%, grain boundary embrittlement is prevented and SSC-resistance is improved remarkably. Therefore, if improvement of SSC-resistance is particularly required, Si should not be positively added and its content should be depressed up to 0.1%, more preferably up to 0.05%.

Mn:

Mn also is an element contained inevitably in steel and contributes to deoxidization and desulfurization of steel. It may be added positively in order to obtain these effects, preferably not less 0.1%. If content of the Mn exceeds 1.5% however, toughness and SSC-resistance of the steel are deteriorated, therefore the content should be suppressed up to 1.5%, preferably up to 1.0%.

When deoxidization by Al and desulfurization by the later mentioned Ca are fully achieved, the content of Mn as an impurity is preferably not more than 0.1%, and the less the better. On the in-line quenching, when Mn content is suppressed to less than 0.1%, grain boundary segregation of Mn which deteriorates SSC-resistance because of embrittlment of grain boundary is decreased. It is still more desirable that the Mn content is suppressed not more than 0.05%.

Lowering of Mn and Si contents:

When a steel pipe is subjected to the in-line heat-treatment in the process of this invention, SSC-resistance of the steel is improved remarkably by means of controlling each content of Mn and Si into less than 0.1%. The reason for this improvement has not been completely elucidated, but it is thought as follows:

In the conventional re-heat quenching process, Mn and Si segregate around grain boundaries during comparatively slow rate cooling to room temperature after the pipe manufacturing process, even if Si and Mn contents are reduced to less than 0.1%. Grain boundary segregation of Mn and Si does not disappear in the usual retaining time of re-heating before quenching because too much time is needed for diffusion of the segregated Mn and Si. In the in-line heat-treatment, since the steel pipe is complementarily heated after the pipe manufacturing step, and then is quenched directly, the pipe is rapidly cooled and passes, in short time, through the temperature range, wherein the Mn and Si segregation occurs. Accordingly, precipitation of Mn and Si around grain boundaries is almost prevented.

The above mentioned reducing of either Si or Mn content shows remarkable effect in improvement of SSC-resistance. Although it is effective to suppress either Si or Mn to less than 0.1%, the effect becomes larger if both elements are reduced less than 0.1%.

P:

P is an element contained inevitably in steel. Since P is detrimental to toughness and SSC-resistance of the steel because of segregation around grain boundaries, its content should be suppressed to no more than 0.05%, preferably no more than 0.025%. In order to improve SSC-resistance especially, it is desirable for the content to be suppressed not more than 0.002%.

S:

As an incidental impurity as well as P, more than 0.01% S forms large size inclusions which is harmful to toughness and SSC-resistance of the steel. Therefore S should be controlled in a range of 0.01% or less. Especially for the purpose of a significant improvement in SSC-resistance of the steel, it is desirable to suppress S content to not more than 0.0007%.

Lowering contents of P and S:

An in-line-heat-treatment procedure is adopted in the process of this invention method. In this process, if the upper limit of content of impurities P and/or S is controlled lower, an outstanding SSC-resistance of the steel pipe can be obtained as shown in the example described later. Namely, excellent SSC-resistance is obtained when the content of P is restricted to not more than 0.005%. If the content is not more than 0.002%, the improvement becomes excellent. Excellent SSC-resistance is attained also when S content is suppressed to 0.0007% or less and the effect becomes larger when the content of S is not more than 0.0003%. It is considered that the reason why SSC-resistance improves remarkably by reducing P and S contents, particularly when the in-line heat treatment is adopted, is based on a similar principle of reducing Mn and Si contents as described above.

In the conventional reheating and quenching method after rolling, grain boundary segregation of P and precipitation of MnS occur in the steel during the cooling to room temperature. The segregated P or the precipitated MnS can not sufficiently disperse or resolve in the steel matrix in the conventional reheating step for quenching. Even if P or S content is reduced less than 0.005% or 0.0007% respectively, the segregation or the precipitation remains. On the other hand, it is hard to have the segregation or the precipitation in case of the in-line heat treatment, wherein the pipe is complementarily heated and directly quenched, because the pipe passes rapidly by quenching through the temperature range wherein the segregation and the precipitation occur easily. In other words, the amounts of solid solution of P and MnS increase. Accordingly, it is possible that the segregation or the precipitation scarcely occurs if the P or the S content is suppressed to not more than 0.005% or 0.0007% respectively.

Since the effect of reducing P or S to an extremely low level does not depend on each other, the reduction of either element is effective. However, it is desirable that both elements are controlled simultaneously below the above-mentioned upper limits. By reducing both of the P and S, the SSC-resistance of the steel is extremely improved.

Ni:

Ni has an effect to improve toughness of the steel, but it is a detrimental element to SSC-resistance. Therefore, its content should be restricted up to 0.1% even if it is added. The intentional addition of Ni is not necessary.

W:

W is not an indispensable alloying element. The addition of W, however, increases strength of the steel owing to improvement of the hardenability, and increases resistance to temper softening and improves SSC-resistance. Therefore, it is possible to use W together with Mo to improve the temper softening resistance, keeping the previously mentioned content of Mo within the range in which SSC-resistance is not injured. In order to improve SSC-resistance of the high strength steel pipe such as C125 grade or higher, for example, it is indispensable to adopt a high temperature tempering of over 600° C. If a decrease of the strength of the steel by high temperature tempering is intended to compensate with only a Mo content increase, the SSC-resistance is deteriorated by the precipitation of large needle-like Mo-carbide, owing to excessive amounts of Mo. W has the same effect as Mo on the temper softening resistance, and has an advantage in that large carbide is hard to be formed owing to slow diffusion rate based on heavy atomic weight of about 2 times of Mo. Therefore, the addition of W for replacing a part of Mo makes it possible to obtain the steel composition to be tempered at high temperature without addition of an excessive amount of Mo. That is, the steel which contains W, together with not more than 1.5% Mo, is able to be tempered at high temperature and thereby can have a higher level SSC-resistance.

In case of an addition of W, the range of W content should be 0.1–2.0%, preferably less than 1.0%, because the effect of a W addition is insufficient with less than 0.1%, and when the content exceeds 2.0%, the effect is saturated and occurring segregation induces deterioration of SSC-resistance of the steel.

The reason why the high temperature tempering is desirable is as follows: if steels which have been tempered at various temperatures have the same strength, the steel tempered at the higher temperature has the better SSC-resistance because of decreased internal residual strain and progressed spherodizing of cementite.

V:

V is also not an indispensable alloying element, but, for example, it is a useful element particularly for the high strength seamless pipe of C140 grade or over, i.e., the pipe having no less than 140 ksi(about 98 kgf/mm$^2$) yield strength. V precipitates fine particles of carbide in the steel during tempering, and increases the resistance to temper softening. Although Nb containing steel has enough resistance to temper softening without V addition, the resistance improves remarkably by addition of V together with Nb. Therefore, the steel containing Nb and V can be tempered at a high temperature over 650° C. which is desirable for improvement of SSC-resistance of the said ultra high strength steel pipe. Not less than 0.1% V is desirable to assure the above mentioned effect of V. However, it should be not more than 0.5% because toughness of steel deteriorates when V content exceeds 0.5%.

Zr:

Zr addition is effective to increase yield point elongation in tensile test of the steel, and thereby improves SSC-resistance of the steel. Since Zr is an expensive alloying element, its addition is not always necessary. However, the Zr addition is preferable for further improvement of SSC-resistance. Its content should be restricted up to 0.5%, because inclusions increase and the toughness deteriorates when the content exceeds 0.5%.

B:

A small amount of B improves hardenability and SSC-resistance of particularly heavy thickness steel materials. In the steel for the process of this invention, B also is not an indispensable alloying element but can be added as needed. When B is added for improvement, it is better that the content of B is not less than 0.0001% because the effect of addition does not appear clearly under 0.0001%. On the other hand, since toughness and SSC-resistance are deteriorated by more than 0.01%, its content should be up to 0.01%.

Ca:

Ca combines with S to form sulfide and improves shapes of inclusions, in the steel, and thereby improves SSC-resistance. It should be decided properly whether to add Ca or not, because the extent of the effect varies with S content and the corrosion resistance of the steel is deteriorated sometimes by its addition if the deoxidization of the steel is insufficient. When Ca is added, it is desirable for the content range to be controlled into 0.0001–0.01%. If the content is less than 0.0001%, the effect is not remarkable. On the other hand excessive amounts of Ca not only causes surface defects of the pipe but also deteriorates the toughness and corrosion resistance of the steel. Therefore, the tipper limit of the Ca content is 0.01%.

N (nitrogen):

Since N is inevitably contained in steel and deteriorates the toughness and the SSC-resistance of the steel, it should be controlled to not more than 0.01%. Although the N content is not able to be zero, the less the better.

Since the affinity of N with Ti in the steel is extremely large, it should be considered that both of the N and Ti contents satisfy the following formula in order to make the effect of the addition of Ti definite.

$$Ti(\%)>(48/14)\times N(\%)$$

The said formula becomes the following (b) for the steel containing Zr.

$$Ti(\%)-(48/14)\times\{(\%)-(14/91)\times Zr(\%)\}>0 \quad (b)$$

O (oxygen):

O exists inevitably in steel as an impurity and deteriorates the toughness and SSC-resistance of the steel. The content should be restricted to not more than 0.01% the same as N, and the less the better.

II. Pipe Manufacturing and Heat Treatment

Referring to FIG. 1, each step of the process of this invention is explained hereinafter.

(A) Heating of Billet:

FIG. 1 is a flow diagram showing an example of the process of this invention for producing seamless steel pipes from billet heating to in-line quenching. Heating temperature of the billet in the heating furnace 1 should be in a range to allow hot piercing with a pierce 2 arranged next to the furnace 1. Since an optimum billet heating temperature is different by the composition of the steel, the temperature should be decided with consideration of ductility and strength of the steel at elevated temperatures. The general range of the billet heating temperature is 1100 to 1300° C. The heating method can be any conventional one such as gas heating and induction heating. In order to realize a billet heating of high efficiency, it is preferable that the billet has an integral multiple length of the length of the billet to be supplied to the pierce and also that the billet is cut off to the piercing length, by cutting equipment installed next to the heating furnace 1, before piercing.

Manufacturing history of the billet, which is charged into the furnace, is not important. Any billet, such as a billet made by blooming or continuous casting with a round shape mold, can be used. For the energy saving, it is recommendable that the billet, which has been manufactured by blooming or continuous casting, is charged into the furnace before being cooled to room temperature.

(B) Piercing;

Piercing is the step for manufacturing a raw pipe (hollow shell) by making a hole through the billet at an elevated temperature. There are various piercing methods such as skew-roll piercing, press piercing, and any of these methods can be used in the process of this invention.

Figure 2:
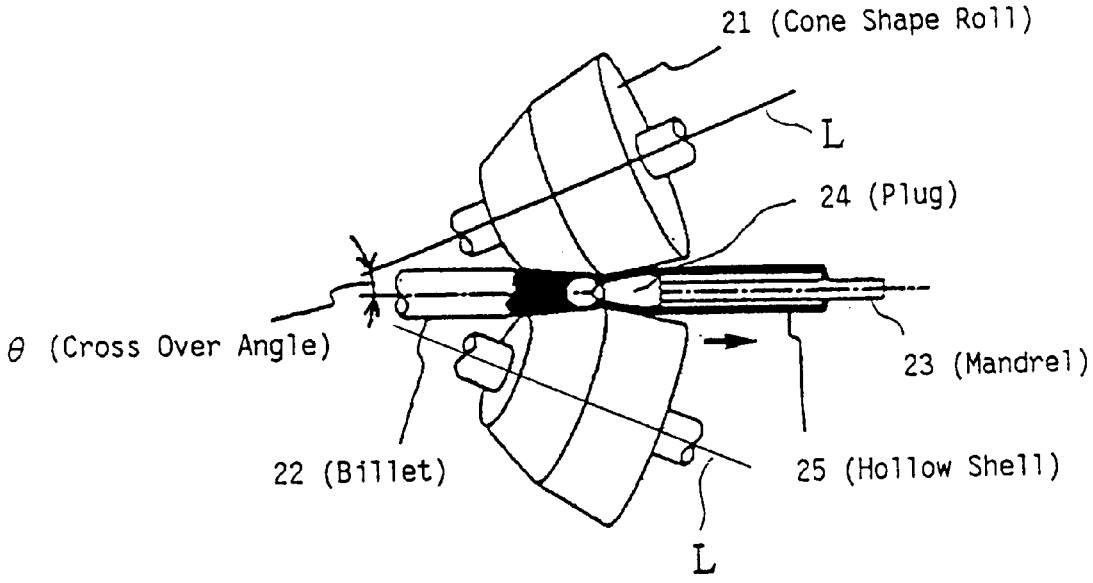
FIG. 2 is a partially sectional side-view showing the pierce having cross over arranged cone type forming rolls.

FIG. 2 shows a partially cross sectional side-view of a cross over type pierce with cone shape rolls which is recommendable to be used for the process of this invention. In this piercer, the cone type rolls 26 are arranged on the upper and lower sides of pass line 21 so that the center lines of the rolls may cross over. The billet 22 is driven in the direction of the arrow and pierced by a plug 24 supported by a mandrel 23. Thus a hollow shell 25 is made. Cross over angle to be mentioned later is the angle (θ) between the center line L of the roll and the horizontal plane including the pass line.

The reason why the pierce shown in FIG. 2 is recommendable for the process of this invention is as follows: in order to enlarge the reduction ratio in the subsequent steps, i.e., elongating and finish rolling steps, it is favorable that the billet have been pierced into an expanded and thin wall hollow shell. A large mill power over the capacity of the conventional mill is required sometimes for rolling a thick wall hollow shell at high reduction. When the cross over type pierce with cone shape rolls is applied, the wall thickness of the hollow shell is able to be thinner than that of the hollow shell which is pierced by the usual pierce with barrel shape rolls; and it becomes possible that a heavy working of more than 40% of combined reduction of elongating and finish rolling is carried out easily. In this piercing step, it is favorable for the cross over angle (θ in FIG. 2) to be in the range of 5 to 35 degrees. If the angle is smaller than 5 degrees, it is difficult to obtain a required thin wall hollow shell. On the other hand, if the angle is larger than 35 degrees, the piercing procedure becomes unstable because of clogging of the bottom end of the hollow shell, i.e., the pierced pipe can not pass through the piercer.

Since the surface defects of hollow shell tend to be induced during piercing as the billet temperature becomes lower, it is preferable to heat the billet before piercing by a supplementary heating apparatus, for example an induction heating apparatus installed before the piercer 2.

(C) Hot Rolling (Elongating rolling and Finish rolling):

The hot rolling consists of two steps, i.e., "elongating rolling" step, wherein the pierced hollow shell is rolled and elongated, and "finish rolling" step, wherein the elongated pipe is further rolled for the final seamless pipe which has a required shape and sizes. In the process shown in FIG. 1 as example, the elongating mill is the mandrel mill 3, and the finish rolling mill is the sizer 4. The term, "Reduction ratio of hot rolling", in this specification, means the total reduction ratio in "elongating rolling" and "finish rolling". Working temperature of the hot rolling is lower than that of the piercing. Consequently, the hot rolling is an important step which dominates the effects of the thermo-mechanical treatment.

In the process of this invention, the reduction ratio of hot rolling is restricted to not less than 40% in cross sectional reduction of the pipe wall and the finishing temperature (temperature of the pipe immediately after the finish rolling) is restricted within the range of 800–1100° C., preferably within 800–1050° C.

If the reduction ratio of the hot rolling is less than 40%, the effect of grain refining can not be obtained because recrystallization does not progress smoothly, even if the complementary heating is applied and furthermore, abnormal grain growth occurs sometimes.

The upper limit of the reduction ratio can not be generally decided because it depends on the billet composition and the mill capacity. However, it is preferable that the ratio is restricted up to 80% because surface defects tend to be induced when the ratio is too large. If the finishing temperature exceeds 1100° C., the grains grow and the required fine grain structure can not be obtained. Usually the lower finishing temperature makes the recrystallized grains finer, however when the temperature is too low, rolling at over 40% reduction becomes difficult because of increasing deformation resistance of the hollow shell and energy consumption for the complementary heating to be applied after the finish rolling becomes large. Therefore, the lower limit of the finishing temperature is restricted to 800° C.

In the process of this invention, reheating during the hot rolling, i.e., heating between the elongating rolling and the finish rolling is not applied. Since the reheating is not only an excess step, but also it relieves the deformation strain stored in the elongating step in the steel, it is unfit for the purpose of this invention to store a large deformation strain in the steel after the finish rolling. It is desirable that the finish rolling is conducted before the strain, which has been introduced by the elongating, is relieved. For the purpose above, it is recommendable to use a compact apparatus in which the elongating rolling mill and the finish rolling mill are arranged close by each other, although usually both of the mills are arranged separately with a considerable distance. As shown in FIG. 1, the elongating mill (mandrel mill 3) and the finish rolling mill (sizer 4) are arranged close by each other so that the top of a pipe being rolled can be bitten in the first stand roll of next mill (sizer 4) while the rear end of the pipe is still in the former mill (mandrel mill 3). It is preferable to use an extracting sizer for the finish rolling mill.

(D) Complementary Heating:

The complementary heating is a step wherein the pipe, after finish rolling, is heated complementarily. The complementary heating equipment 5 shown in FIG. 1 can be any kind of equipment in which the temperature is able to be precisely controlled. Usual combustion heating furnace, electric heating furnace or induction heating furnace can be used. However, equipment such as a common heat insulating cover, in which neither heating nor temperature control can be carried out, are not suitable.

The complementary heating step is the most important characteristic of the process according to this invention. This step is applied for the purpose of refining the grain structure of the steel pipe before quenching by recrystallization, as well as introducing a large number of dispersed fine precipitation particles, which suppresses the abnormal grain growth by preventing grain boundary movement. The steel pipe, thus recrystallized and quenched, thereafter has fine and uniform grain structure which is the same as that of the pipe subjected to the conventional off line reheating-quenching at worst.

In case of a process wherein the pipe is reheated during hot rolling (between the elongating rolling and the finish rolling), another reheating at rather high temperature is necessary after the finish rolling and the grain refining effect of recrystallization decreases. In contrast with the said process, the grain refining effect by recrystallization reaches the maximum in the process of this invention by applying the complementary heating immediately before quenching. In addition, the complementary heating makes it easy to control the quenching temperature precisely and to suppress anisotropy of mechanical properties of the pipe.

The recrystallization and refining of the grains are achieved by the combination of the complementary heating and the high reduction ratio of the hot rolling. In contrast with the usual process comprising the reheating step during hot rolling, the steel is not worked after the complementary heating in the process of this invention. Accordingly, the temperature of the complementary heating can be selected in the lowest recrystallizing temperature range. Even if the steel pipe is fully soaked at the temperature for a long time, there is no possibility of undesirable grain growth. The fine recrystallized grain structure can be obtained by only one complementary heating.

The complementary heating temperature T (°C.) and time t (hr) should satisfy the preceding formula (a), i.e., the value of $(T+273)\times(21+\log t)$ should be in the range of 23500–26000. If the value is lower than 23500, the recrystallization does not finish completely. On the other hand, if the value exceeds 26000, the effect of increasing resistance to temper softening can not be obtained in the next tempering step after quenching because the carbonitride of Nb and Ti coagulates into large particles or most of the solute Ti and Nb in the steel precipitates as carbonitride. In this case, ultra fine and uniform grain structure can not be obtained, and consequently improvement of corrosion resistance (SSC-resistance) becomes poor.

Neither the temperature (T) nor time (t) is required to be a constant value during the complementary heating. Insofar as the condition of formula (a) is satisfied, it is allowed that T is changed stepwise or continuously and t may be controlled according to the thus changed T. More precisely, it is allowed that the complementary heating is carried out at a temperature T (°C.) for a time t (hr) so that the value of fn2 may be controlled within the range of 23500–26000, wherein fn2=(T+237)×(21+log t). Embodiments of the heating are as follows:

(1) The value of fn2 is controlled within 23500–26000 at an optional constant temperature T (°C.) for time t (hr). (2) Provided soaking times are $t_1$, $t_2$, . . . , and $t_n$ at each temperature $T_1$, $T_2$, $T_3$, . . . , and $T_n$ in a complementary heating, the soaking time $t_2$, $t_3$, . . . , and $t_n$ at temperature $T_2$, $T_3$, . . . , and $T_n$ are converted into $t_{21}$, $t_{31}$, . . . , and $t_{n1}$ at the temperature $T_1$. Thereafter, the value of fn2 is controlled within 23500–26000 assuming that the pipe is heated at the temperature $T_1$ for a time "$t_1+t_{21}+t_{31}+ \ldots +t_{n1}$".

As mentioned above, the temperature and the time of the complementary heating are decided by the equation (a), but the temperature (T) should be selected to be not lower than 850° C. If the temperature is lower than 850° C., transformation to ferrite occurs. Since the grains grow to coarse if the temperature exceeds 1100° C., it is desirable that the temperature is not higher than 1100° C. An appropriate time range of the complementary heating is about 10 seconds to 30 minutes.

When the complementary heating is introduced between the finish rolling and quenching treatment, favorable secondary effects are obtained as follows. One of these effects is that the quenching temperature can be controlled properly. Another effect is that temperature differences between positions in length and circumference directions in a pipe, and between pipes in a lot can be minimized. By this homogeneous heating, variation of properties by positions in a steel pipe and scatter of properties in the steel pipes in a lot decrease, and reliability of the products is enhanced.

(E) In-line Quenching:

It is also a major characteristic of the process of this invention that the above mentioned complementary heating and succeeding quenching are conducted together in a pipe manufacturing line. As previously mentioned, this treatment is called "in-line quenching" in this specification, since it is quite different from "direct quenching" wherein the pipe is quenched immediately after the finish rolling.

It is required for the in-line quenching that the quenching temperature is no lower than the $Ar_3$ transformation point because the steel should be rapidly cooled from the austenite state. In the process of this invention the pipe is heated at a temperature no lower than 850° C. by the said complementary heating. Since the $Ar_3$ transformation point of the steel for the process, having the previously mentioned composition, is not higher than 850° C., the quenching temperature over $Ar_3$ point is secured when the steel pipe is quenched immediately after discharge from the complementary heating equipment. Quenching is conducted by using cooling equipment 6, which is arranged just after the complementary heating equipment as shown in FIG. 1.

The cooling rate of quenching at the in-line quenching is not limited in particular. The cooling rate can be selected appropriately in accordance with chemical compositions of the steels so that required low-temperature transformation structure may be obtained in the whole wall thickness of the steel pipe. However, since the larger cooling rate the more the SSC-resistance of the produces is improved, quenching by water is preferable.

(F) Last Tempering:

When the quenched steel pipe, having the low temperature transformation structure of fine uniform grains, is tempered at a temperature not higher than $Ac_1$ point, required properties (strength, toughness, and corrosion-resistance) are given to the steel pipe. That is to say, a high strength seamless steel pipe, which has the desired excellent SSC-resistance, is able to be obtained after this tempering treatment. The last treatment in the process of this invention is the tempering, regardless of a presence of an intermediate heat treatment described later.

The tempering should be carried out by sufficient soaking because it is an important treatment dominating the properties of product. When temperature scattering of tempering is controlled within ±10° C., preferably ±5° C., the scattering of strength (tensile strength and yield strength) of the pipe is able to be suppressed within ±5 kgf/mm$^2$. A lower limit of the tempering temperature needs not be decided particularly, but when the tempering is conducted at higher temperature, the properties of the seamless steel pipe, especially SSC-resistance, is more improved, because internal strain and stress in the low-temperature transformation structure generated by quenching is relieved or eliminated and carbide is spherodized. Accordingly, the recommendable tempering temperature is not lower than 550° C., preferably not lower than 650° C. for C140 grade.

(G) Intermediate Quenching between In-line Quenching and the Last Tempering:

In the process of this invention, since the grain structure of the steel pipe just before the quenching is refined by recrystallization in the complementary heating after the finish rolling, seamless steel pipes, having sufficient properties for practical use, can be obtained by adopting only the tempering (the last tempering) after the in-line quenching. In other words, since the steel pipe, which has been subjected to the in-line quenching and only one time tempering has high strength, high toughness and excellent corrosion resistance, it can be used satisfactorily without any other heat treatment in a severe corrosive environment.

Depending on circumstances, further high rank of toughness and corrosion resistance is sometimes demanded. In this case it is required that the grain structure should be a much finer uniform one. This ultra fine uniform grain structure is able to be obtained by applying one or more times of "intermediate heat treatment" between the in-line quenching and the last tempering. The intermediate heat treatment consists of a quenching (intermediate quenching) or combination of the quenching and a tempering (intermediate tempering). Accordingly, the intermediate heat treatment includes various embodiments. Processes of the heat treatment from the in-line quenching to the last tempering are illustrated for examples as follows. Indicating the in-line-quenching, the intermediate quenching, the last tempering and the intermediate tempering as IQ, MQ, FT and MT respectively, there are the following 7 typical processes of heat treatment.

① IQ→FT
② IQ→MQ→FT
③ IQ→MT→MQ→FT
④ IQ→MQ→MQ→FT
⑤ IQ→MQ→MT→MQ→FT

⑥ IQ→MT→MQ→MQ→FT

⑦ IQ→MT→MQ→MT→MQ→FT

When the condition of the formula (a) is satisfied in the complementary heating step, excellent toughness and corrosion resistance of the steel is obtained because the carbonitride of Nb and Ti does not coagulate into coarse particles by tempering, coarsening and abnormal growth of the grain of steel is suppressed, and furthermore, the effect of increasing the resistance of temper softening is retained.

In the intermediate quenching step, it is preferable that the in-line quenched steel pipe is quenched after reheating at a temperature range from the $Ac_3$ transformation point to "the $Ac_3$ transformation point +100° C.".

In the seamless steel pipe which is in-line quenched according to this invention, many fine carbonitride particles of Nb and Ti precipitate and a proper quantity of dissolved Nb and Ti is contained. When the pipe is reheated and intermediate-quenched, the abnormal grain growth is suppressed and the ultra fine uniform grain structure is obtained because grain boundary movement is inhibited. The grain structure becomes finer by repeating this intermediate quenching treatment and under this condition the toughness and corrosion resistance of the steel improves. If the heating temperature for intermediate quenching is lower than the $Ac_3$ transformation point, the quenching is ineffective because the steel does not reach a fully austenite state. On the other hand, if heating temperature exceeds "the $Ac_3$ transformation point+100° C.", the seamless steel pipe does not have the required properties because of coarsened grain structure.

The heating rate of reheating for the intermediate quenching is favorable to be large, therefore it is desirable to use reheating equipment such as the electromagnetic induction heater. The cooling rate of the intermediate quenching is desirable to be large, the same as that of the in-line quenching. When two or more intermediate quenchings are applied, it is desirable that the reheating temperature of the subsequent quenching is lower than that of the preceding one for improvement of toughness and corrosion resistance.

The intermediate tempering is applied mainly in order to prevent delayed fracture that is called, "season cracking". Release of hydrogen dissolved in the steel is promoted by this tempering and the delayed fracture is able to be prevented. Accordingly, it is desirable to apply the intermediate tempering for prevention of the delayed fracture after quenching, particularly when the waiting time for the next quenching step is expected to exceed 5 hours.

The upper limit of the intermediate tempering temperature should be not higher than the $Ac_1$ transformation point for the required properties of seamless steel pipe. In order to definitely obtain the ultra fine uniform grain structure with the subsequent reheating and quenching treatment, it is desirable that the intermediate tempering temperature is not higher than 700° C. The lower limit of the intermediate tempering temperature may be 500° C. for example, which is enough to prevent the delayed fracture.

The effect of this invention will be explained more concretely in the following Example.

EXAMPLE

Steels "a" to "s", having compositions shown in FIG. 3, were melted in a vacuum induction furnace and cast into ingots of 150 kg each. The steels "a" to "o" in the FIG. 3 are the steels suitable for raw material of the process of this invention (referred to as "the steels of this invention" hereinafter), and the steels "p" to "s" are comparative steels in which contents of alloying elements are out of the ranges defined in this invention.

Steel plates of 12 mm thick, 80 mm wide and 600 mm long were made of these steel ingots by hot working. The hot working was a hot forging simulating the piercing in the process for manufacturing seamless steel pipes. Both of the elongating rolling by a mandrel mill and finish rolling by a sizer mill were simulated by rolling in a plate rolling mill.

The cross sectional reduction ratio of the pipe, which is used generally as the deformation ratio for steel pipes, is almost the same as the deformation ratio represented by the reduction of thickness in plate rolling. Therefore, properties of the plate samples estimated in this example can be considered to be properties of the pipe produced in the practical manufacturing line.

FIG. 4 shows differences of SSC-resistance depending on chemical compositions of the steels. The hot working and heat treatment process were the processes of this invention comprising the "complementary heating" and "in-line quenching". The conditions were as follows:

1. Heating temperature before forging (simulating the piercing)—1200° C.
2. Reduction ratio of forging (simulating the piercing)—40%.
3. Reduction ratio of hot rolling (simulating the elongating and finish rolling)—80%.
4. Finishing temperature of the finish rolling—860° C.
5. Temperature of the complementary heating—900° C.
6. Time of the complementary heating—5 minutes.
7. Temperature of the in-line quenching (without the intermediate heat treatment)—870° C.

Steel plates having various strength for the evaluation of SSC-resistance were prepared by changing the tempering temperature, and the plates after tempered were evaluated by the constant load method of NACE TMO177 METHOD-A. The adopted load stress was 80% of the true yield strength, and SSC-resistance was evaluated with the maximum yield strength without breaking.

It is apparent from FIG. 4 that the threshold strength of SSC-resistance of any sample of test No. 1–15, using the steels of this invention, was higher than that of any sample of test Nos. 16–19 using the comparative steels, i.e., the SSC-resistance has been improved. Particularly, improvement of SSC-resistance of the steels containing W or V (steel "e", "n", "f" and "o") is large compared with that of the steel (steel "a") without these elements. The effect of W or V is apparent. The samples made of steels "g" to "m" with low level content of Si, Mn, P and S (test No. 7–13) showed an excellent SSC-resistance. Among them, the sample of test No. 13 made of steel "m", in which all contents of Si, Mn, P and S were restricted to extremely low level, has the most excellent SSC-resistance. It is clear from these test results that the SSC-resistance can be improved remarkably by controlling Si, Mn, P and S contents to low level.

FIG. 7 and 8 show properties of the samples which were made of the steels shown in FIG. 3 under various conditions of working and heat treating as shown in FIG. 5 and 6. Samples of test Nos. 1–6, 25–29, 35 and 36, using the steels "a" and "b", were adjusted to the C125 grade and other samples using other steels were adjusted to the C140 grade. The Sc values were estimated by NACE TMO177 METHOD-B (three-point bending method) and SSC-resistance was evaluated by inspection of crack generation in the test according to METHOD-A (constant load test) in which stress of 80% of the specified minimum yield strength was loaded on the specimen.

The abnormal grain growth was detected as follows: a cross section of the sample was scanned along 1000 $\mu$m length with using a conventional linear analyzer and the average cut length of grains was measured by counting intersection points of the scanning linear line and grain boundaries. On the other hand, a cut length of the largest grain was measured in five fields of view in a microstruture photograph of 200 times (7 cm×10 cm )at a random position on the same sample. The samples, in which the ratio of the cut length of the largest grain to the average cut length is 3 or more, were classified into the group of abnormal grain growth, while the samples with the said ratio of not more than 3 were classified into the group of no abnormal grain growth.

In case of the C125grade, using steel "a" and steel "b", the samples of test Nos. 35 and 36, which were manufactured in a process corresponding to the conventional process of reheating and quenching after rolling, do not have satisfactory SSC-resistance. On the contrary, the samples of test Nos. 1–6, manufactured in a process corresponding to the process of this invention, have excellent SSC-resistance and toughness which had not been obtained in the conventional process.

In case of comparative examples, test Nos. 25–29, the working and/or heat treating conditions were out of those of this invention. Any sample of these test numbers does not have sufficient SSC-resistance. The abnormal grain growth was found in some samples and toughness and Sc values are low. Furthermore, there were some samples of very low strength such as the sample of test No. 29.

Next, the properties of samples of steels "e", "n", "f", "l" and "o" which were adjusted to the C140 grade are as follows:

Test Nos. 37–42 are examples produced in the conventional process comprising the steps of reheating and quenching after rolling. These samples have good properties in Sc value and toughness, but all of these were broken in the constant load test of Method-B.

Samples of test Nos. 30–34 were comparative examples which were produced under conditions of working and heat treating out of those defined in this invention. All of these samples do not have satisfactory SSC-resistance. Abnormal grain growth was found in some samples, and toughness and Sc value are poor. There was an example of very low strength such as the sample of test No. 34. However, the excellent SSC-resistance which has not been attained in the conventional process was obtained in the samples produced in the process of this invention shown as test Nos. 7–24.

In the examples subjected to the intermediate heat treatment after the in-line quenching, under the condition of this invention, it was found that Sc value and toughness were improved by the refining of grain structure, although there could not be found so large difference in test results of METHOD-A of the C125 grade samples (test Nos. 2, 3, 5 and 6) or the C140 grade samples (test Nos. 8, 9, 11, 12, 14, 15, 17, 18, 20, 21, 23 and 24).

INDUSTRIAL APPLICABILITY

The process for producing a seamless steel pipe, according to this invention, is the process wherein the pipe manufacturing and the heat treating thereof are carried out in one production line. Accordingly, the effect of process shortening and energy saving is much larger compared with the conventional process comprising the off line reheating and quenching steps.

Furthermore, the properties of the seamless steel pipe produced in this process are equal or superior to those of the pipe which is manufactured in the conventional reheating, quenching and tempering process. At this point the process of this invention is superior to the usual direct quenching process.

According to this invention, it is able to produce seamless steel pipes corresponding to not only the C110 grade, but also the C125 grade or over, having high strength and excellent SSC-resistance, at low cost. This invention contributes for a stable energy supply by decreasing the cost of oil well development, especially by promoting the development of very deep oil wells which used to be difficult to develop.

We claim:

1. A process comprising steps of hot piercing and hot rolling for producing a high strength seamless steel pipe, having excellent sulfide stress cracking resistance, characterized by using a billet of low alloy steel which contains, in weight %, 0.15–0.50% of C, 0.1–1–1.5% of Cr, 0.1–1.5% of Mo, 0.005–0.50% of Al, 0.005–0.50% of Ti and 0.003–0.50% of Nb, and comprising the followings steps:

(1) hot piercing the billet into a hollow shell, (2) hot rolling the hollow shell with 40% or more of cross sectional reduction ratio, (2) the hollow shell (3) finishing the hot rolling in a temperature range of 800–1100° C., (4) putting the manufactured steel pipe promptly in a complementary heating apparatus after the finish rolling, and complementarity heating at the temperature and time satisfying the following formula (a), (5) quenching the steel pipe immediately after taking out of the complementary heating apparatus, and (6) tempering the pipe at a temperature not higher than the $Ac_1$ transformation point as the last heat treatment, $$23500 \leqq (T+273)\times(21+\log t) \leqq 26000 \quad (a)$$

where, T (°C.) is a temperature of not lower than 850° C., and t is a time (hr).

2. A process for producing a high strength seamless steel pipe, having excellent sulfide stress cracking resistance according to claim 1, characterized by further comprising one or more times intermediate heat treating which consists of quenching or combination of quenching and tempering, between the above-mentioned quenching step (5) and the last heat treatment step (6).

3. A process for producing a high strength seamless steel pipe, having excellent sulfide stress cracking resistance according to claim 1, characterized by using the steel billet which consists essentially of, in weight %, 0.15–0.50% of C, up to 1.5% Mn, 0.1–1.5% of Cr, 0.1–1.5% of Mo, 0.005–0.50% of Al, 0.005–0.50% of Ti, 0.003–0.50% of Nb, up to 0.010% of N, up to 0.01% of O, up to 0.05% of P, up to 0.01% of S, up to 0.1% of Ni, up to 0.5% of V, up to 0.5% of Zr, up to 0.01% of B, up to 0.01% of Ca, up to 2.0% of W, and the balance of Fe and incidental impurities, and each amount of Ti, Zr and N is defined by the following formula (b).

$$Ti(\%)-(48/14)\times\{N(\%)-(14/91)\times Zr(\%)\} \geqq 0 \quad (b)$$

4. A process for producing a high strength seamless steel pipe, having excellent sulfide stress cracking resistance according to claim 3, wherein the steel billet further contains 0.05–0.5 weight % of V.

5. A process for producing a high strength seamless steel pipe having, excellent sulfide stress cracking resistance according to claim 3 or claim 4, using the steel billet in which Si content or Mn content is not more than 0.1 weight % respectively, or both of Si content and Mn content are not more than 0.1 weight %.

6. A process for producing a high strength seamless steel pipe, having excellent sulfide stress cracking resistance according to claim 3, or claim 4, using the steel billet in which P as an impurity is not more than 0.005 weight %, or S as an impurity is not more than 0.0007 weight %, or P as an impurity is not more than 0.005 weight % and S as an impurity is not more than 0.0007 weight %.

7. A process for producing a high strength seamless steel pipe, having excellent sulfide stress cracking resistance according to claim 5, using the steel billet in which P as an impurity is not more than 0.005 weight %, or S as an impurity is not more than 0.0007 weight %, or P as an impurity is not more than 0.005 weight % and S as an impurity is not more than 0.0007 weight %.

* * * * *

UNITED STATES PATENT AND TRADEMARK OFFICE

CERTIFICATE OF CORRECTION

PATENT NO.: 5,938,865
DATED : August 17, 1999
INVENTOR(S): KONDO et al.

It is certified that an error appears in the above-identified patent and that said Letters Patent is hereby corrected as shown below:

On the title page of the patent item [73] the assignee, "Sumitomo Metal Industries, LTC.," should be --Sumitomo Metal Industries, LTD.,--.

Signed and Sealed this

Twenty-eighth Day of March, 2000

*Attest:*

Q. TODD DICKINSON

*Attesting Officer*

*Commissioner of Patents and Trademarks*

UNITED STATES PATENT AND TRADEMARK OFFICE

CERTIFICATE OF CORRECTION

PATENT NO.: 5,938,865
DATED : August 17, 1999
INVENTOR(S): KONDO et al.

It is certified that errors appear in the above-identified patent and that said Letters Patent is hereby corrected as shown below:

In the Claims;

In claim 1 on line 14 of column 22, change "0.1-1-1.5%" to be --0.1-1.5%--

In claim 1 on line 21 of column 22, delete "(2) the hollow shell"

In claim 1 on line 35 of column 22, change "T(°C.)" to be --T(°C)--

Also in claim 1 on line 35 of column 22, change "850°C.," to be --850°C,--

In claim 3 on line 46 of column 22, change "claim 1, characterized" to be --claim 1 or claim 2, characterized--

In claim 3 on line 47 and 48 of column 22, change "... of C, up to ..." to be --... of C, up to 1.5 % of Si, up to ...--

Signed and Sealed this

First Day of May, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 5,938,865
DATED : August 17, 1999
INVENTOR(S) : Kondo et al.

It is certified that error appears in the above-identified patent and that said Letters Patent is hereby corrected as shown below:

Column 14,
Line 14, change "Ti(%)-(48/14)x{(%)-(14/91)xZr(%)}> 0 (b)" to be -- Ti(%)-(48/14)x {N(%)- (14/91)xZr(%)}>0 (b) --

Signed and Sealed this

Sixth Day of November, 2001

*Attest:*

Nicholas P. Godici

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 5,938,865
DATED : August 17, 1999
INVENTOR(S) : Kondo et al.

It is certified that error appears in the above-identified patent and that said Letters Patent is hereby corrected as shown below:

Title page,
Item [73], the assignnee, "Sumitomo Metal Industries, LTC.," should be
-- Sumitomo Metal Industries, LTD., --.

Signed and Sealed this

Eighteenth Day of June, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 5,938,865
APPLICATION NO. : 08/952222
DATED : August 17, 1999
INVENTOR(S) : Kondo et al.

It is certified that error appears in the above-identified patent and that said Letters Patent is hereby corrected as shown below:

In column 4;
on line 21 change "5-571772" to be -- 6-184711 --

In column 8;
on line 25 change "Ti(%)-(48/14)x{N(%)-(14/91)xZr(%)}" to be
-- Ti(%)-(48/14)x{N(%)-(14/91)xZr(%)}>0 --

In column 17;
on line 15 change "fn2=(T+237)x(21+log t)" to be -- fn2=(T+273)x(21+log t) --

In Claim 3;
on line 56, of column 12, change "Ti(%)–(48/14)x{N(%)–(14/91)xZr(%)}≧0 (b)" to be
-- Ti(%)–(48/14)x{N(%)–(14/91)xZr(%)}>0 (b) --

Signed and Sealed this

Nineteenth Day of May, 2009

JOHN DOLL
*Acting Director of the United States Patent and Trademark Office*